US007165694B2

(12) United States Patent
Schütz

(10) Patent No.: US 7,165,694 B2
(45) Date of Patent: Jan. 23, 2007

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 269 days.

(21) Appl. No.: 10/418,192

(22) Filed: Apr. 17, 2003

(65) Prior Publication Data

US 2003/0230580 A1 Dec. 18, 2003

(30) Foreign Application Priority Data

Apr. 25, 2002 (DE) ..... 202 06 652

(51) Int. Cl.
*B65D 25/14* (2006.01)
*B65D 19/30* (2006.01)
*B65D 88/00* (2006.01)

(52) U.S. Cl. ..... 220/9.4; 206/386; 220/1.5; 220/1.6; 220/23.9

(58) Field of Classification Search ..... 220/1.5, 220/9.1, 23.9, 592.21, 9.4, 1.6; 206/386, 206/599, 600
See application file for complete search history.

(56) References Cited

U.S. PATENT DOCUMENTS 2,897,999 A * 8/1959 Bishop ..... 220/9.4
3,517,849 A * 6/1970 Presnick ..... 220/4.33
4,676,373 A * 6/1987 Schneider ..... 206/386
4,909,387 A * 3/1990 Schutz ..... 206/386
5,316,174 A * 5/1994 Schutz ..... 206/386
5,366,090 A * 11/1994 Schutz ..... 206/600
5,497,895 A * 3/1996 Rudbach ..... 220/4.33
5,507,392 A * 4/1996 Schutz ..... 206/600
5,678,688 A * 10/1997 Schutz ..... 206/386
5,704,477 A * 1/1998 Hermann et al. ..... 206/386
5,971,185 A * 10/1999 Schutz ..... 220/1.6
6,029,839 A * 2/2000 Mansouri ..... 206/600
2002/0144925 A1* 10/2002 Busch ..... 206/524.2

FOREIGN PATENT DOCUMENTS

DE 197 20 931 A1 12/1998

* cited by examiner

*Primary Examiner*—Gary E. Elkins
(74) *Attorney, Agent, or Firm*—Friedrich Kueffner

(57) ABSTRACT

A transport and storage container for liquids includes a pallet-like underframe of electrically conductive material for supporting an exchangeable inner container of plastics material with four side walls, a lower and an upper bottom, a closeable fill socket integrally formed with the upper bottom and an outlet socket with a removal fitting integrally formed at a lower portion of a side wall, an outer casing formed of vertically and horizontally extending metal crate rods, and a single-piece or multi-piece support insert with four side walls of an electrically conductive material arranged between the inner container and the outer casing. Wall elements of the support insert are provided with a structure having a plurality of adjacent structure elements, such as hexagons, circles, honeycombs, trapezoids, lozenges, squares and rectangles.

7 Claims, 2 Drawing Sheets

TRANSPORT AND STORAGE CONTAINER FOR LIQUIDS

BACKGROUND OF THE INVENTION

1. Field of the Invention

The present invention relates to a transport and storage container for liquids including a pallet-like underframe of electrically conductive material for supporting an exchangeable inner container of plastics material with four side walls, a lower and an upper bottom, a closeable fill socket integrally formed with the upper bottom and an outlet socket with a removal fitting integrally formed at a lower portion of a side wall, an outer casing formed of vertically and horizontally extending metal grate rods, and a single-piece or multi-piece support insert with four side walls of an electrically conductive material arranged between the inner container and the outer casing.

2. Description of the Related Art

A transport and storage container of the above-described type disclosed in DE 197 20 931 C2 has the disadvantage that the support insert arranged between the inner container and the outer casing increases the empty weight of the container.

SUMMARY OF THE INVENTION

Therefore, it is the primary object of the present invention to improve the construction of the transport and storage container of the above-described type so as to reduce the weight of the container.

In accordance with the present invention, wall elements of the support insert are provided with a structure having a plurality of adjacent structure elements, such as hexagons, circles, honeycombs, trapezoids, lozenges, squares and rectangles.

The container for liquids according to the present invention has the following advantages.

By providing the wall elements of the support insert which are preferably made of sheet metal material with a structure having a plurality of adjacent structural elements, such as hexagons, circles, honeycombs, trapezoids, lozenges, squares and rectangles, the stability of the support insert is increased, so that the thickness of the sheet metal of the wall elements of the insert and, thus, the empty weight of the container can be reduced. By providing the wall elements of the support insert with a structure, the generation of high lights resulting from the radiation of the sun is prevented. The support insert contributes to an increase of the strength of the inner container of plastics material, so that the manufacturing costs of the transport and storage container are reduced because of a reduction in the number of grate rods of the outer casting and the necessary welded connections at the intersections of the grate rods. Electrical charges which may be generated on the surfaces of the inner container of plastics material during filling and emptying of the container are discharged into the ground through the support insert, the outer casing and the pallet-like underframe which is also manufactured of an electrically conductive material. The electrical grounding of the inner container of plastics material makes it possible to use the transport and storage container as a container for dangerous materials, such as flammable liquids, for example, paints, varnishes and solvents with a flame point of less than 35° C., and the container can be used in rooms in which an explosive atmosphere can be formed by gases, vapors or mists. The support insert improves the fire safety of the container.

Moreover, the support insert ensures an effective protection of the inner container of plastics material as well as of the filling material against ultraviolet radiation. Finally, by integrating the support insert with its wall elements composed of profiled sheet metal into the outer grate casing of the inner container of plastics material, it is possible to construct the side walls of the inner container with appropriate protrusion which engage into the wall elements of the support element and, thus to increase the filling volume of the transport and storage container while maintaining the standard dimensions of the container.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
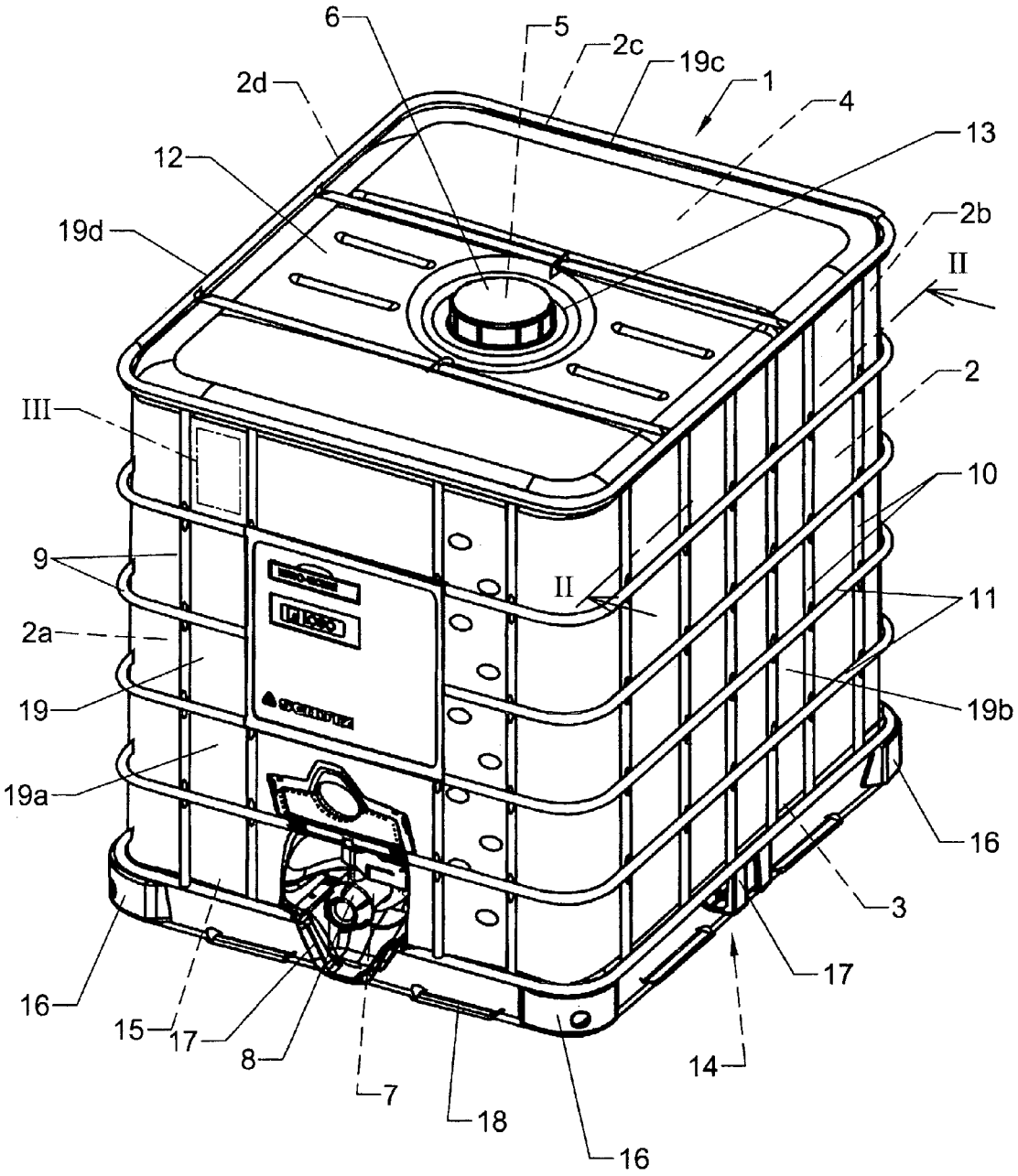
FIG. 1 is a perspective view of a transport and storage container according to the present invention.
Figure 2:
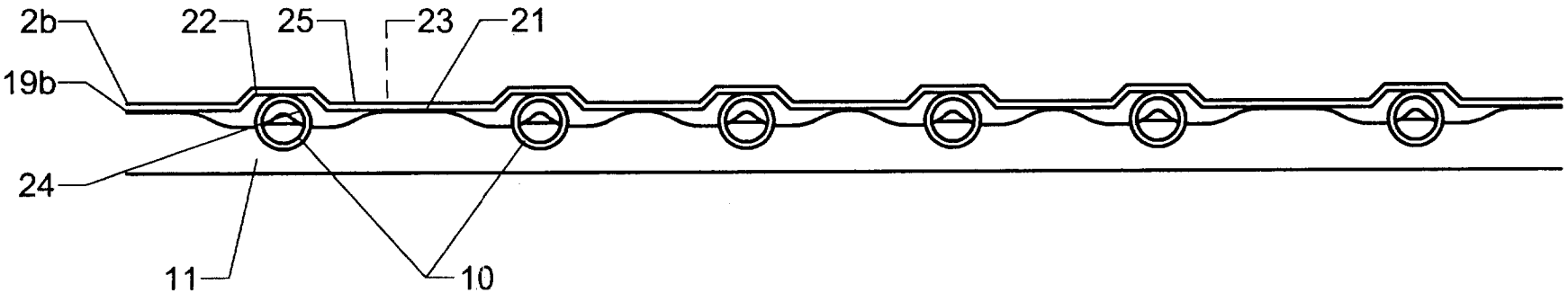
FIG. 2 is a horizontal sectional view, on a larger scale, of a side wall area of the container taken along sectional line II—II in FIG. 1.
Figure 3:
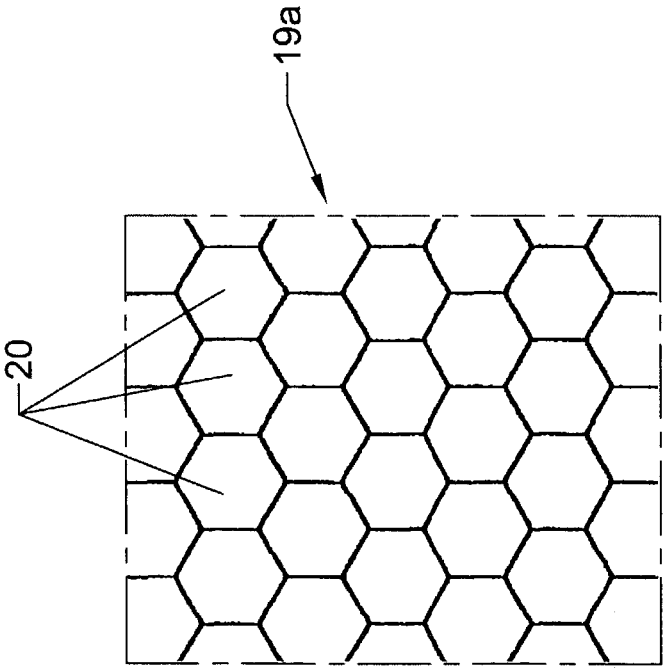
FIG. 3 is an enlarged illustration of detail II of FIG. 2 showing a hexagonal structure of a wall element of the support insert of the container.

The transport and storage container 1 illustrated in FIGS. 1 and 2, which may be used for single use or multiple uses, includes as principal components an exchangeable parallelepiped inner container 2 of plastics material, particularly polyethylene, with four side walls 2*a*–2*d*, a lower bottom 3 constructed as a discharge bottom, and an upper bottom 4 with a fill socket 5 which can be closed by a screw cap 6. The inner container 2 further includes an outlet socket 7 with a removal fitting 8 integrally formed at the lower portion of the end wall 2*a*, an outer casing 9 of intersecting vertically and horizontally extending grate rods 10, 11 of metal, a removable protective cap 12 of metal attached to the outer casing 9 and with a central access opening 13 to the fill socket 5 of the inner container 2, and a pallet-like underframe 14 with a bottom trough 15 of sheet metal for receiving the inner container 2 of plastics material.

To provide a clearance at the bottom, the bottom trough 15 rests on corner and middle legs 16, 17 and a base frame 18 or on slides, so that, for transporting the transport and storage container 1, the gripping arms of a transport device, for example, a fork lift, can move underneath the bottom trough 15 from four sides. The legs 16, 17 and the base frame 18 or the slides are of metal or an electrically conductive plastics material, for example, polyethylene with a conductive soot content. The pallet-like underframe 14 of the transport and storage container 1 has standardized length and width dimensions.

Arranged between the inner container 2 of plastics material and the outer casing 9 of the transport container 1 is a support insert 19 with four wall elements 19*a*–19*d* of sheet metal material. The wall elements are provided with a structure having a plurality of adjacent structure elements 20 which, in the illustrated embodiment, are configured as hexagons.

Instead of the illustrated container configuration, the structure elements 20 of the wall elements 19*a*–19*d* of the support insert 19 may have the geometric shape of circles, honeycombs, trapezoids, lozenges, squares and rectangles.

The wall elements 19*a*–19*d* of the support insert 19 are constructed as trapezoid section elements with individual sections 21, 22 which are alternatingly directed outwardly and inwardly. The outwardly directed individual sections 21 of the wall elements 19*a*–19*d* are arranged in the intermediate spaces 23 between always two vertical grate rods 10 which protrude inwardly with a rod segment 24 beyond the horizontal grate rods 11 of the outer casing 9. The inwardly directed individual sections 22 of the wall elements 19*a*–19*d* receive the inwardly projecting rod segments 24 of the vertical grate rods 10. The side walls 2*a*–2*d*, which in the filled state of the inner container 2 rest against the wall elements 19*a*–19*d* of the support insert 19, are provided with bulges or protrusions 25 which engage in the outwardly directed individual sections 21 of the wall elements 19*a*–19*d* of the support insert 19.

The bulges 25 in the side walls 2*a*–2*d* of the inner container 2 serve to compensate for the reduction of the volume of the inner container 2 caused by the lower bottom 3 of the inner container 2 constructed as a discharge bottom.

In a modification of the above-described embodiment of the transport and storage container 1, the wall elements 19*a*–19*d* of the support insert 19 may be constructed as box sections. Also, the wall elements 19*a*–19*d* of the support insert 19 can be manufactured of a plate material of electrically conductive plastics material, for example, polyethylene, with a conductive soot content.

While specific embodiments of the invention have been shown and described in detail to illustrate the inventive principles, it will be understood that the invention may be embodied otherwise without departing from such principles.

I claim:

1. A transport and storage container for liquids comprising an exchangeable inner container of plastics material with four side walls, a lower bottom and an upper bottom, a closeable fill socket integrally formed at the upper bottom, and an outlet socket with a removal fitting integrally formed with a lower portion of one of the side walls, a pallet-like understructure of electrically conductive material for supporting the inner container, an outer casing comprised of vertically and horizontally extending grate rods of metal, a single-piece or multi-piece support insert having at least one wall element of an electrically conductive material, wherein the at least one wall element of the support insert is comprised of a structure having a plurality of adjoining structure elements, wherein the structure elements are selected from the group consisting of hexagons, circles, honeycombs, trapezoids, lozenges, squares and rectangles, wherein the wall element of the support insert is a section element comprised of individual sections alternatingly directed outwardly and inwardly, wherein the outwardly directed individual sections of the wall element are arranged in intermediate spaces between the vertically extending grate rods which protrude with a rod segment inwardly beyond the horizontally extending grate rods of the outer casing, and the inwardly directed individual sections of the wall element receive the inwardly protruding rod segments of the vertically extending grate rods, and wherein the side walls of the inner container, which in a filled state of the inner container rest against the wall element of the support insert, engage with bulges in the outwardly directed individual sections of the wall element of the support insert.

2. The transport and storage container according to claim 1, wherein the support insert has four wall elements.

3. The transport and storage container according to claim 1, wherein the wall elements of the support insert are constructed as box sections.

4. The transport and storage container according to claim 1, wherein the wall elements of the support insert are of sheet metal material.

5. The transport and storage container according to claim 1, wherein the wall elements of the support insert are of a plate material of an electrically conductive plastics material.

6. The transport and storage container according to claim 5, wherein the electrically conductive plastics material is polyethylene with a conductive soot content.

7. The transport and storage container according to claim 1, wherein the support insert has a number of wall elements constructed as trapezoid section elements.

* * * * *